United States Patent [19]

Suzuki et al.

[11] Patent Number: 4,665,597

[45] Date of Patent: May 19, 1987

[54] METHOD FOR PRODUCTION OF NON-WOVEN FABRIC

[75] Inventors: Migaku Suzuki; Toshio Kobayashi; Shigeo Imai, all of Kawanoe, Japan

[73] Assignee: UNI-Charm Corporation, Ehime, Japan

[21] Appl. No.: 769,148

[22] Filed: Aug. 26, 1985

Related U.S. Application Data

[63] Continuation of Ser. No. 567,069, Dec. 30, 1983, abandoned.

[30] Foreign Application Priority Data

Dec. 31, 1982 [JP] Japan ..... 57-233998

[51] Int. Cl.[4] ..... D04H 1/46; D04H 5/02; D04H 3/10

[52] U.S. Cl. ..... 28/104

[58] Field of Search ..... 28/104, 105, 106, 107

[56] References Cited

U.S. PATENT DOCUMENTS 3,113,349 12/1963 Nottebohm et al. ..... 28/104 X
3,214,819 11/1965 Guerin ..... 28/104 X
3,917,785 11/1975 Kalwaites ..... 28/104
4,152,480 5/1979 Adachi et al. ..... 28/104 X
4,172,172 10/1979 Suzuki et al. ..... 28/104 X

FOREIGN PATENT DOCUMENTS 781428 11/1937 France ..... 28/107

*Primary Examiner*—Robert R. Mackey
*Attorney, Agent, or Firm*—Fred Philpitt

[57] ABSTRACT

A method for fiber entangling of a fibrous web by subjecting said web to a treatment by high velocity water jets on support members, in which said support members comprise a water-pervious support member and water-impervious support member arranged in contact with the lower surface of said water-pervious support member. As said water-pervious support member, a porous screen or a plurality of belts spaced from one another transversely of the fibrous web and as said water-impervious support member, members each having a flat or circular surface on which the web is supported are employed. Preferably, these support members are arranged in a preliminary treatment station for the fibrous web.

5 Claims, 10 Drawing Figures

METHOD FOR PRODUCTION OF NON-WOVEN FABRIC

This is a continuation of application Ser. No. 567,069, filed Dec. 30, 1983, now abandoned, and the benefits of 35 USC 120 are claimed relative to it.

FIELD OF INDUSTRIAL APPLICATIONS

The present invention relates to a method for production of non-woven fabrics by a high velocity water jet treatment and, more particularly, to a method for production of non-woven fabrics having substantially no openings by subjecting a fibrous web to a treatment by high velocity water jets directed from nozzle means onto said fibrous web supported by support means.

PRIOR ARTS

As the methods for production of non-woven fabrics in which individual fibers are held entangled by the high velocity water jet treatment, there have already been proposed the method in which a water-pervious support member comprising a porous screen (net) is employed as the support means serving to support the fibrous web during the treatment and the method in which a roller, a curved plate, or the like is employed as the water-impervious support member. The former is disclosed, for example, in U.S. Pat. Nos. 3,449,809 and 3,485,706 and the latter is disclosed, for example, in U.S. Pat. No. 4,172,172.

In the method employing the water-pervious or porous support member, the water jets directed onto the fibrous web pass through the support means and are effectively drained. So far as such feature is concerned, no disturbance occurs in texture of the fibrous web and the treatment is achieved with a satisfactory stability. However, fibers are susceptible to be twined with pores of the support means so that the texture of the fibrous web is sometimes disturbed when peeled off from said support means. The water streams passing through the fibrous web and then the support means still have a considerable pressure, but such remaining pressure is not sufficiently utilized as energy for the fiber entangling treatment. Such inconvenience will be more serious as the basic weight of the fibrous web decreases. Accordingly, it is impossible to obtain a product having a desirable strength with good texture. Neither improvement of productivity nor reduction of production cost can be expected and the fiber entangling treatment requires extremely high pressure water jets, necessarily resulting in economically disadvantageous production equipment of a large scale.

In the method utilizing the water-impervious or non-porous support member, on the other hand, the water streams directed onto the fibrous web pass through said web and rebound on the surface of the support means and these rebounding streams act again upon said web so far as the drainage is effectively achieved, so that the fiber entangling is efficiently accomplished under the interaction of the water jets and the rebound streams. In consequence, this method is free from the disadvantages of said method utilizing the water-pervious support means. However, this method is inevitably accompanied by the problem of drainage, since the water streams cannot pass through the support means. If the drainage is insufficient, the high velocity water jets act upon the fibers floating in water staying on the support means and the energy of these high velocity water jets is rapidly absorbed by such water staying on the support means so that such water jets can not achieve effective fiber entangling treatment. Furthermore, the texture of the fibrous web is disturbed and the stability of treatment is reduced. Thus, it is impossible to obtain a product of excellent properties, such as good texture and a desired strength.

The inventors have already disclosed in British Pat. No. 2,085,493 and French Pat. No. 2,488,920 an improved method for production of non-woven fabric by which, with respect to such method utilizing the water-impervious support means, the problem of drainage is effectively solved and thereby non-woven fabric of excellent properties can be mass-produced at a reasonable cost. With these disclosures, there are provided a plurality of support means arranged at intervals transversely of a direction in which the fibrous web travels, supply of high velocity water streams to the respective support means is regulated to be less than a predetermined amount and the preliminary treatment is achieved by the support means comprising a water-impervious endless belt. In this method, it is essential to arrange the support means at intervals to solve the problem of drainage, and it is preferred to minimize the web supporting surfaces of the respective supporting means to obtain the optimum effect of said drainage. However, the smaller the web supporting surfaces, the lower the stability with which the fibrous web can be supported by these supporting surfaces. Furthermore, the texture of the fibrous web would be disturbed unless the fibrous web travels from a support means to a support means with a high stability during the treatment. Such inconvenience becomes serious in production of non-woven fabric having a relatively low basic weight, for example, of 30 g/m 2 or less, particularly during the initial treatment step.

OBJECT OF INVENTION

A principal object of the present invention is to provide a novel and improved method for production of non-woven fabrics which eliminates disadvantages of both methods of prior art utilizing only the water-pervious support means and utilizing only the water-impervious support means and maintains the advantages of the respective methods of prior art while having the advantages which can not be obtained by these well known methods.

More particularly, a principal object of the present invention is to obtain non-woven fabrics of excellent properties by a combination of a water-pervious support means and a water-impervious support means having a web supporting surface which is relatively small so aas to improve a drainage effect on these support means as well as to improve stability with which the fibrous web is supported and transported on this web supporting surface so that no disturbance of texture occurs even during the fiber entangling treatment of a fibrous web having a basic weight as low as of 15 to 100 $g/m^2$.

SUMMARY OF INVENTION

To achieve such object, the present invention provides a method for production of non-woven fabrics comprising the steps of introducing a fibrous web onto a supporting means and subjecting said fibrous web to a fiber entangling treatment under high velocity water jets provided through orifices of nozzle means arranged at predetermined pitches transversely of the fibrous web, said water jets being directed against the surface of said fibrous web supported by said support means, characterized by that said support means comprises a water-pervious support member and a water-impervious support member underlying said water-pervious support member and maintained in contact therewith and said treatment is achieved at a position at which these both support members are in contact with each other. As said water-pervious support means, a porous screen or a plurality of non-porous or porous belts arranged at suitable intervals transversely of the fibrous web may be employed and as said water-impervious support means, a member having a web supporting surface which is flat or circularly convex.

DETAILED DESCRIPTION OF THE INVENTION

Preferred embodiments of the present invention will be now described.

Figure 1:
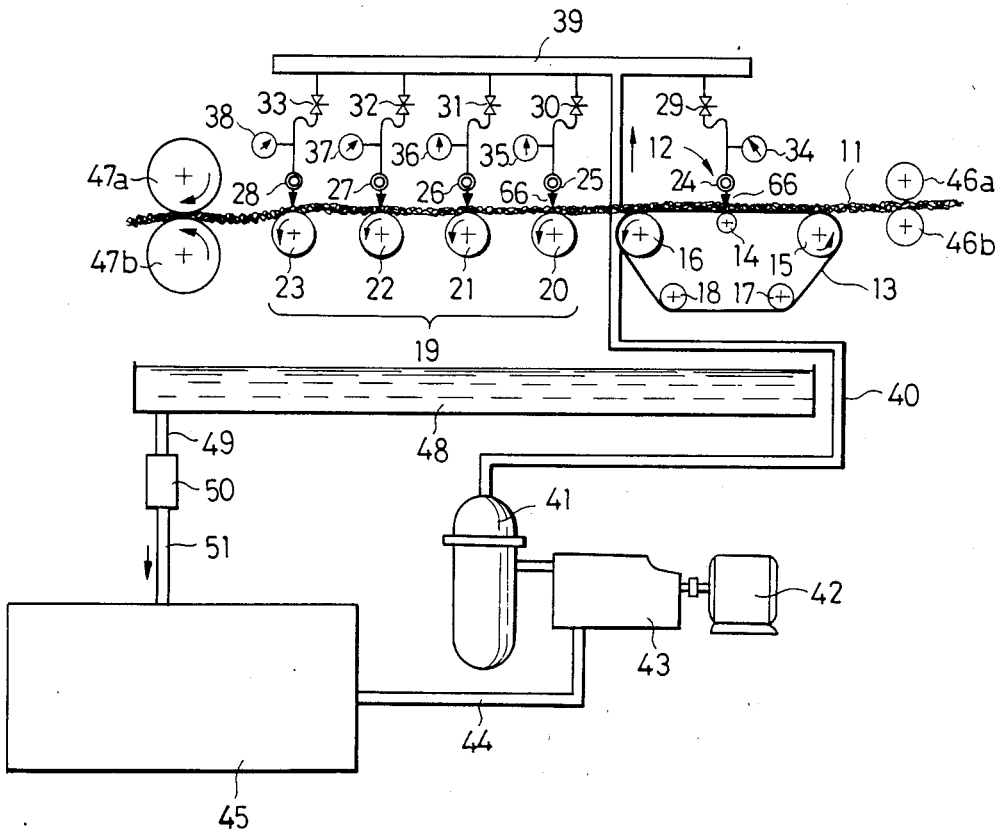
FIG. 1 is a schematic side view showing an apparatus for execution of the present invention.

Referring to FIG. 1, in the preliminary treatment station 12, an endless porous screen (net) 13 (see FIG. 2) serving as the water-pervious support member travels around on rotatable rollers 15, 16, 17, 18 so as to be kept in contact with a top surface of a rotatable roller 14 serving as the water-impervious support member. In a proper treatment station 19 following said preliminary treatment station 12, rotatable rollers 20, 21, 22, 23 each having a diameter of 50 to 300 mm serving as the water-impervious support members are spaced from one another and spaced from said station 12. Nozzle means 24, 25, 26, 27, 28 are arranged above said support members 14, 20, 21, 22, 23, respectively, in association with them and each of these nozzle means is provided in its bottom surface with a plurality of orifices transversely arranged and opened toward a fibrous web 11. These nozzle means are connected via regulating valves 29, 30, 31, 32, 33 and pressure gauges 34, 35, 36, 37, 38, respectively, to a distributor tank 39. The distributor tank 39 is connected by a pipe 40 to a filter tank 41, which is, in turn, connected to a pressure pump 43 driven by an electromotor 42. The pressure pump 43 is connected via a pipe 44 to a supply tank 45. There are provided upstream of the preliminary treatment station 12 a pair of nip rollers **46*a*, 46*b* adapted for press of the fibrous web 11 and another pair of nip rollers 47*a*, 47*b* are arranged downstream of the proper treatment station 19 to squeeze water out of the fibrous web 11. A collector tank 48 is placed in a region extending under the stations 12, 19 and the nip rollers 47*a*, 47*b* and said collector tank 48 is connected through a pipe 49, a filter box 50 and a pipe 51 to the supply tank 45**.

In this arrangement, an amount of water contained in the supply tank 45 is pressurized by the pressure pump 43, filtered by the filter tank 41 and then supplied to the distributor tank 39 which distributes, in turn, this pressurized water to the respective nozzle means 24, 25, 26, 27, 28. Thus the respective nozzle means provide through the respective orifices, which are 0.05 to 0.2 mm in diameter and arranged at a pitch of 0.5 to 10 mm, water jets 66 each at a desired jet pressure, e.g., a nozzle back pressure of 7 to 35 kg/cm$^2$ towards the fibrous web 11 with a basic weight of 15 to 100 g/m$^2$ travelling on the support members 14, 20, 21, 22, 23. In such manner, the fibrous web 11 introduced from the nip rollers **46*a*, 46*b* into the treatment station 12 is preliminarily subjected to a fiber entangling treatment on the support members 13, 14. This preliminary treatment imparts the fibrous web 11 a sufficient strength that the fibrous web 11 is kept against any disturbance or damage of texture even under the high velocity water jets 66 from the nozzle means 25, 26, 27, 28 during travel on the support members 20, 21, 22, 23 in the treatment station 19. The fibrous web 11 thus preliminarily treated to some extent is introduced onto the support members 20, 21, 22, 23 in the proper treatment station 19 and subjected to a progressive and final fiber entangling treatment by the high velocity water jets 66 provided from the nozzle means 25, 26, 27, 28. Then the fibrous web 11 is sequeezed between the pair of nip rollers 47*a*, 47*b* and thereby a substantial amount of water contained therein is removed, whereafter the web 11 is transferred to a subsequent drying station (not shown). Excessive amount of water drained at the treatment stations 12, 19 and the nip rollers 47*a*, 47*b* is collected into the collector tank 48 underlying these components, then filtered through the filter box 50 and thereafter circulated back to the supply tank 45**.

Figure 3:
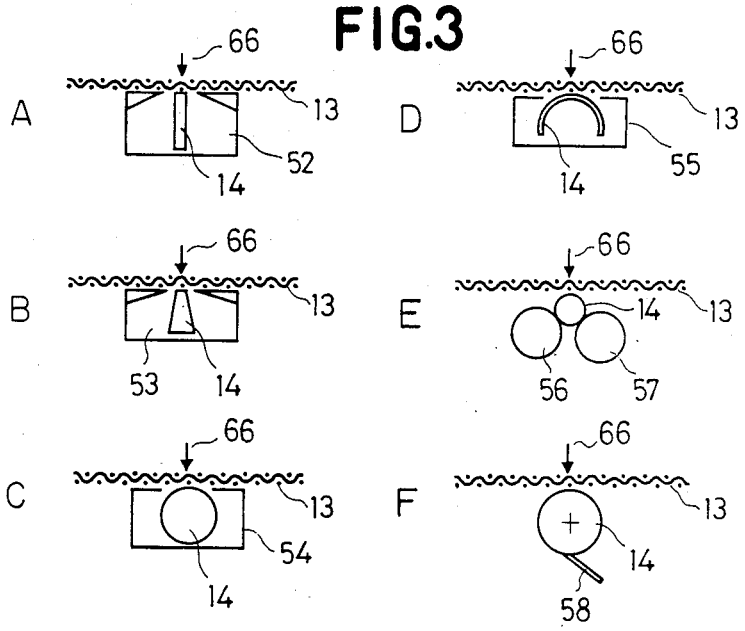
FIGS. 3A, 3B, 3C, 3D, 3E and 3F are schematic diagrams illustrating by way of example the water-impervious support member and the associated drainage arrangement.

The support member 14 may be, for example, a prismatic member having a flat surface on which the web is supported and a square or trapezoidal cross-section as shown by FIGS. 3A and 3B, or a roller or a convexly curved member having a circular surface on which the web is supported as shown by FIGS. 3C, 3D, 3E and 3F. In the case of said prismatic support member 14, the trapezoidal cross-section as shown by FIG. 3B is preferable particularly for improvement of drainage.

A length over which the water-pervious support member 13 and the water-impervious support member 14 are in contact with each other longitudinally of the tibrous web is preferably less than 50 mm, more preferably less than 10 mm and the minimum thereof substantially corresponds to at least an extent over which the high speed water jets strike the fibrous web 11. When said length is 50 mm or longer, the drainage effect would be unacceptably reduced and when said length is substantially smaller than the width of the water jets themselves, said water jets might not be effectively utilized and these water jets would freely pass through the fibrous web 11, resulting in that fibers are twined together with meshes of the screen, which will be described later more in detail, too firmly for easily peeling the fibrous web 11 off from said screen. The support member 14 having a web supporting surface in a circular shape preferably has a curvature radius of 7.0 or higher.

The porous screen 13 should have a width enough to support the fibrous web 11 and meshes thereof should be preferably 40 or more and further preferably 50 or more. With the meshes less than 40, openings would be formed in the fibrous web 11 and the latter would be readily twined together the meshes, resulting in a disturbed texture of the final product.

In a preferred embodiment of the present invention, the length over which the support members 13, 14 are in contact with each other longitudinally of the fibrous web 11 is appropriately adjusted so that an effective drainage is achieved during treatment of the fibrous web 11. For further improvement of the drainage effect, the support member 14 is preferably provided with means adapted for a forcible drainage. As such means, there may be employed suction boxes 52, 53, 54, 55 surrounding the support member 14 as seen in FIGS. 3A, 3B, 3C, 3D, rotatable rollers 56, 57 adapted to be brought in contact with the rotatable support member 14 to achieve a desired drainage as seen in FIG. 3E, and a doctor blade 56 adapted to be brought in contact with the rotatable support member 14 to achieve a drainage effect as seen in FIG. 3F.

Figure 2:
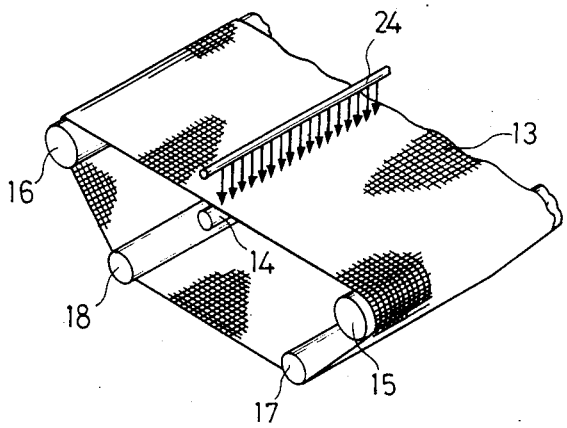
FIG. 2 is a schematic perspective view partially cut away showing a station for preliminary treatment of a fibrous web.
Figure 4:
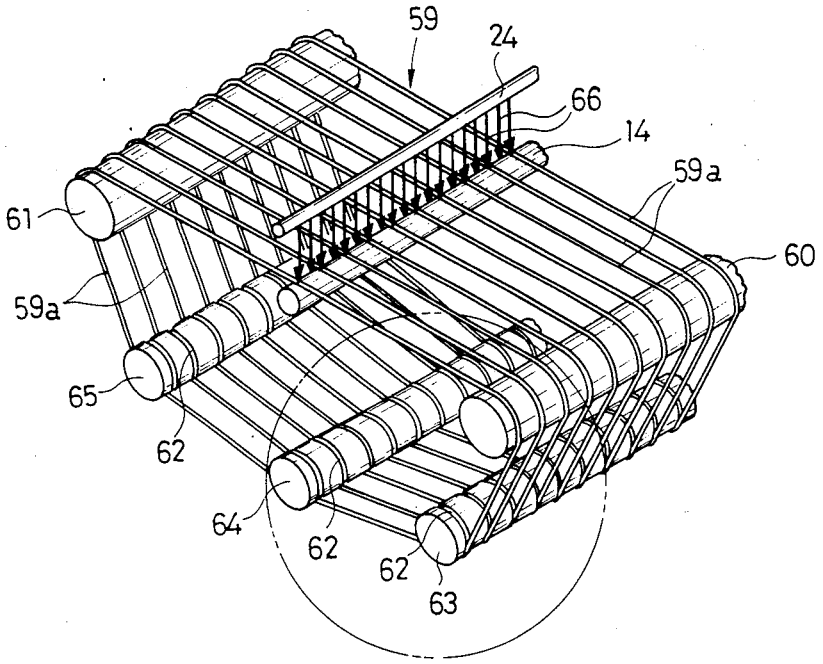
FIG. 4 is a schematic perspective view partially cut away showing another embodiment of the water-pervious support member.
Figure 5:
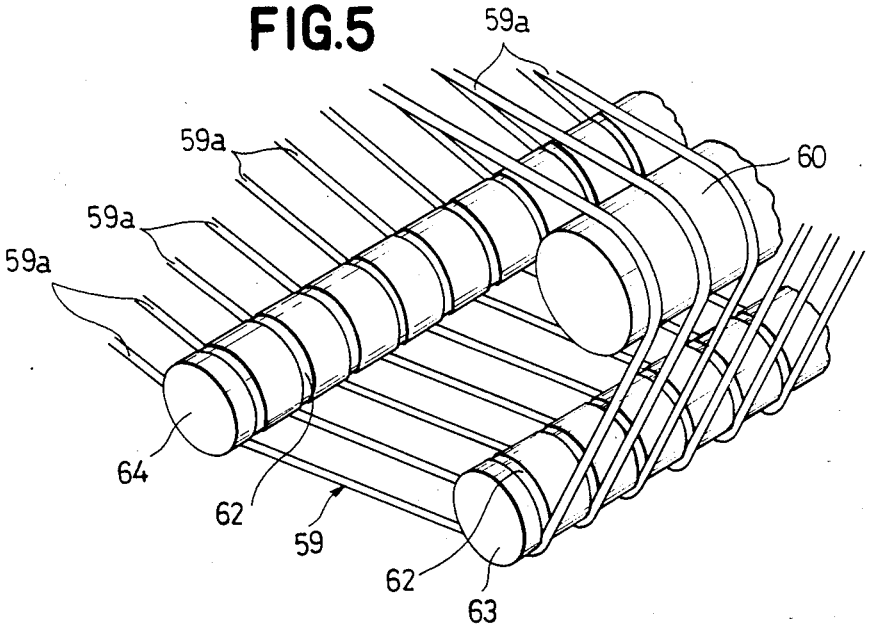
FIG. 5 is an enlarged perspective view showing a circle-enclosed portion in FIG. 4.

FIGS. 4 and 5 show another embodiment of the present invention in which the water-pervious support member 13 comprising said wide porous screen provided in the treatment station 12 as shown by FIGS. 1 and 2 is replaced by a water-pervious support member 59 comprising a plurality of narrower non-porous belts 59*a*.

The respective belts 59*a* are suspended on rotatable rollers 60, 61 and another group of rotatable rollers 63, 64, 65 each having circumferential grooves 62 axially spaced from one another. The respective belts 59*a* forming together the water-pervious support member 59 are, however, non-porous support elements so far as they are individually considered. As an assembly, the support member 59 functions as the water-pervious support member having gaps among the respective component belts 59*a*. Accordingly, such support member 59 is referred to as the water-pervious support member in the present invention.

Each belt 59*a* preferably has a width less than 20 mm, and further preferably less than 10 mm. With the respective belts 59*a* having the width of 20 mm or more, water stays on tops of the respective belts 59*a* and then is drained somewhat transversely of the fibrous web 11, resulting in that fibers of the web 11 are also moved transversely of the fibrous web 11 and thereby disturbs the texture. The acceptable minimum width of each belt 59*a* is preferably 1 mm, although such minimum width is necessarily restricted to maintain desired properties of the respective belts 59*a* themselves such as bending stress and resistance to wear with respect to the water jets. An interval at which each pair of adjacent belts 59*a* are arranged is preferably in a range from said width dimension (1 mm) to 100 mm. With this interval or spacing less than such range, the drainage effect is disadvantageously reduced. With the interval larger than said range, distortion of the fibrous web 11 increases and prevents the fibrous web 11 to be stably transported so that the texture may be readily disturbed. Furthermore, in this case, the fibrous web 11 is caught under the respective belts 59*a* and becomes difficult to be peeled off from the belts 59*a*, which results also in a disturbance of the texture.

A level difference between the top of each belt 59*a* and the support member 14 or a projecting height of each belt 59*a* with respect to the support member 14 is preferably less than 1.0 mm. When such level difference is exceeded, the fibrous web 11 would be transversely stretched under influence of this level difference and fiber distribution would become uneven. This would cause a disturbance of the texture and uneven strength.

Said belts 59*a* may be replaced by porous flat belts each having a suitable width and, in this case, the aforementioned requirement should be met as when said porous screen 13 and belts 59*a* are employed.

The support members 13, 14, 20, 21, 22, 23, 59 may be of any material so far as their surfaces have a desired hardness higher than 50° according to the prescript of JIS (Japanese Industrial Standerd)-K6301 Hs. When the hardness is lower than 50°, the fiber entangling treatment of the fibrous web 11 could not be effectively achieved.

Material for the fibrous web 11 may be selected from all kinds of material which have usually been used as material for non-woven and woven fabrics and the configuration of the components of the web may be random or parallel. The fibrous web 11 is preferably of the basic weight from 15 to 100 g/m$^2$ and, when the basic weight is less than 15 g/m$^2$, unevenness occurs in the fibrous web 11 and no product of substantially homogeneous and good texture can be obtained. With the basic weight higher than 100 g/m$^2$, the water-impervious support members provide no satisfactory function.

The pressure of the high velocity water jet and, more strictly to say, the back pressure of the nozzle should be in a range from 7 to 35 kg/cm$^2$ and, more preferably, in a range from 15 to 30 kg/cm$^2$. A pressure exceeding 35 kg/cm$^2$ would increase movement of individual fibers within the fibrous web 11, thereby disturbing the web texture and cousing uneven fiber entangling. A pressure lower than 7 kg/cm$^2$ would make it impossible to obtain a final product of excellent properties even when the lower ends of the respective nozzle means 24, 25, 26, 27, 28 are brought close to the fibrous web 11 or the treatment is done for a longer time.

The product obtained according to the present invention has substantially no openings and an embossing roll may be employed as the downstreammost support member 23 to obtain a product having a correspondingly embossed pattern on its surface.

The fiber entangling treatment by using a combination of the water-pervious support member 13 or 59 and the water-impervious support member 14 has been described hereinabove as being carried out in the preliminary treatment station 12, but such treatment of this combination may be performed in the proper treatment station 19 also, if necessary, and is not limited to the treatment station 12.

WORKING EFFECT

As aforementioned, the fibrous web is supported by a combination at least of the water-pervious support member of good drainage and the water-impervious support member and said fibrous web is treated on the top surfaces of these support members in accordance with the present invention. This feature permits a fibrous web of low basic weight which otherwise would be susceptible to a texture disturbance due to drained water of the high velocity water jets particularly in the preliminary treatment station and during transport to be treated without such texture disturbance. Moreover, the present invention permits the fiber entangling treatment to be efficiently achieved even under the high velocity water jets of relatively low pressure and thereby makes it possible to mass-produce products of good texture and desired strength at a low cost. Thus the present invention not only overcomes all the disadvantages of the well known methods in which the water-pervious support member and the water-impervious support member are separately used to support the fibrous web but also maintains all the advantages of such well known methods and provides novel advantages which can never obtained from the well known methods. The present invention thus largely contributes to improvements of the known methods for production of non-woven fabric.

EXAMPLE 1

This Example illustrates that a combination of the porous support member (porous screen) and the non-porous support member (prismatic member) is important in the preliminary treatment station to obtain non-woven fabrics of a low basic weight and of good texture and desired strength.

A mixture of 1.4 d×44 mm polyester fibers and 1.5 d×44 mm rayon fibers at a ratio of 50/50 was processed by a roller card of random type to obtain webs of 40 g/m$^2$ and 20 g/m$^2$, respectively. These webs were treated only in the preliminary treatment station as shown by FIG. 1 and then left to be dried to obtain samples.

A wide 50 meshes brass screen was used as the porous support member in the preliminary treatment station. As the non-porous support member, a prismatic member having a flat supporting surface of 1 mm wide and provided with suction box as shown by FIG. 3A was employed. As the nozzle means, those provided with the orifices arranged at a pitch of 1 mm and each having a diameter of 100μ were employed, and the back pressure thereof was 30 kg/cm$^2$.

As controls, the similar materials were treated only on said mesh screen having no suction box and only on the wide non-porous belt replacing said screen, respectively, then left to be dried to obtain control samples. The remaining conditions were the same as imposed by this Example.

Properties of said samples were as shown in Table 1.

TABLE 1

| Sample No. | Support member | Suction | base weight (g/m$^2$) | Strength (g/25 cm) | Texture | Note |
|---|---|---|---|---|---|---|
| 1 | Mesh screen Prismatic member | Present | 41.5 | 850 | Good | |
| 2 | Mesh screen Prismatic member | Present | 19.2 | 280 | Good | |
| 3 | Mesh screen | Absent | 30.2 | 320 | Fairly good | Many fibers twined on mesh |
| 4 | Mesh screen | Absent | 15.7 | 110 | Rather poor | Many fibers twined on mesh |
| 5 | Non-porous belt | Absent | 40.2 | 1100 | Fairy good | |
| 6 | Non-porous belt | Absent | 21.2 | 150 | Poor | |

(N.B.) Texture was visually evaluated.

EXAMPLE 2

This Example illustrates how important it is that the porous support member (porous screen) is combined with the non-porous support member (primatic member) to obtain non-woven fabric of a low basic weight and of good texture and desired strength.

As the fibrous web, a parallel web having a low basic weight of 20 g/m$^2$ consisting of 1.5 d×51 mm rayon fibers was used. After treated in the apparatus as shown by FIG. 1, this fibrous web was left to be dried to obtain samples.

In the preliminary treatment station, a 30 meshes flat screen of brass was employed as the porous support member and a prismatic member having a flat supporting surface as shown by FIG. 3B was employed as the non-porous support member.

In association with five-staged support members, nozzle means each having orifices of 130μ in diameter and arranged at a pitch of 1 mm were used. Back pressure of the nozzle means was 30 kg/cm$^2$.

Web supporting extent of the support members in the preliminary treatment station and properties of said samples were as shown in Table 2.

TABLE 2

| Sample No. | Support member: Screen mesh | Support member: Support extent of prismatic member (mm) | base weight (g/m$^2$) | Strength kg/2.5 cm | Texture |
|---|---|---|---|---|---|
| 1 | 30 | 3 | 20.5 | 1.5 | Mesh-impression and openings |
| 2 | 50 | 1 | 20.3 | 2.5 | Good |
| 3 | 50 | 3 | 19.8 | 3.2 | Good |
| 4 | 50 | 50 | 19.2 | 2.1 | Good |
| 5 | 50 | 70 | — | — | Non-woven fabric was not obtained due to drain-disturbed texture. |
| 6 | 100 | 3 | 21.5 | 2.7 | Good |
| 7 | 100 | 50 | 19.5 | 2.4 | Good |

EXAMPLE 3

This Example illustrates how important it is to employ the non-porous support member having a web supporting surface of circular convex shape to obtain non-woven fabric of a low basic weight and of good texture and desired strength.

A web of 1.5 d×44 mm acryl fibers is formed by a random card of air spray type into a web having a basic weight of 25 g/m$^2$. After treated by the apparatus as shown by FIG. 1, this web was left to be dried to obtain samples.

In the preliminary treatment station, a 70 mesh flat screen of polyester filaments was used as the porous support member and a rotatable roller as shown by FIG. 3C was used as the non-porous support member. As nozzle means, those each having orifices 85μ in diameter and arranged at a pitch of 0.5 mm were employed in the preliminary treatment station and those each having orifices 110μ in diameter and arranged at a pitch of 1 mm were employed in the proper treatment station. All the nozzle means had a back pressure of 30 kg/cm$^2$.

Diameters of the support members in the preliminary treatment station and properties of said samples were as shown in Table 3.

TABLE 3

| Sample No. | Support member diameter (mm) | base weight g/m² | Strength (kg/25 cm) | Texture |
|---|---|---|---|---|
| 1 | 25 | 23.5 | 2.1 | Good |
| 2 | 25 | 24.2 | 2.0 | Good |
| 3 | 75 | 26.8 | 2.1 | Good |
| 4 | 200 | 24.3 | 1.8 | Drainage caused a certain degree of disturbance. |
| 5 | 300 | — | — | Drainage caused significant disturbance and prevented non-woven fabric from being formed. |

EXAMPLE 4

This Example illustrates how meaningful it is to employ the porous support member comprising a plurality of non-porous belts in the preliminary treatment station to obtain non-woven fabric of a low basic weight and of good texture and desired strength.

A mixture of 1.4 d×44 mm polyester fibers and 1.5 d×44 mm rayon fibers at a ratio of 50/50 was processed through a roller card of random type into a web having a basic weight of 25 g/m². After treated in the apparatus as shown by FIG. 1, this web is left to be dried to obtain samples.

An endless belt of stainless steel wire which had been silver soldered was used as the endless belt in the preliminary treatment station.

As the nozzle means, those each having orifices 100μ in diameter and arranged at a pitch of 1 mm were used. The nozzle means had a back pressure of 30 kg/cm².

Level difference between the top of the porous support member comprising a plurality of said non-porous belts and the top of the non-porous support member, spacings with which said non-porous belts were arranged, and properties of said samples were as shown in Table 4.

TABLE 4

| Sample No. | Level dif. (mm) | Width (mm) | Spacing (mm) | base weight (g/m²) | Strength (g/cm) | Texture |
|---|---|---|---|---|---|---|
| 1 | 0.2 | 0.2 | 10 | 24.6 | 34.2 | Good |
| 2 | " | " | 50 | 25.2 | 38.5 | Good |
| 3 | " | " | 100 | 23.2 | 36.3 | Fairly good |
| 4 | " | " | 125 | — | — | Poor |
| 5 | 0.5 | 0.5 | 50 | 25.1 | 34.8 | Good |
| 6 | 0.7 | 0.7 | 50 | 21.0 | 28.0 | Poor |
| 7 | 0.5 | 10 | 50 | 24.8 | 35.6 | Good |
| 8 | " | 20 | 50 | 23.9 | 32.8 | Rather poor |
| 9 | " | 30 | 50 | — | — | Poor |

We claim:

1. A method for production of non-woven fabrics comprising the steps of introducing a fibrous web having a base weight of 15 to 100 g/m² onto a supporting means and subjecting said fibrous web to a fiber entangling treatment under high velocity water jets provided through orifices of nozzle means at a back pressure of 7 to 35 kg/cm² arranged at predetermined pitches transversely of the fibrous web, said water jets being directed against the surface of said fibrous web supported by said supporting means, the improvement comprising (1) utilizing as the supporting means a water-pervious support member comprising a porous screen of at least 40 meshes together with an underlying water-impervious support member, and (2) maintaining said water-pervious support member in contact with said water-impervious support member over a limited distance which is less than 50 mm measured longitudinally with respect to the fibrous web, (3) carrying out fiber entanglement of the fibers of the fibrous web by directing high velocity water jets against the fibrous web in the area where said water-pervious member and said water-impervious support member are in contact with each other, and (4) said water-pervious support member being moved with said fibrous web relative to said water jets but said water-impervious support member is maintained in an essentially stationary position relative to said water jets.

2. A method according to claim 1 wherein said distance is less than 10 mm.

3. A method according to claim 1 wherein the water-pervious support member comprises a plurality of belts each less than 20 mm in width, arranged at a spacing of a dimension corresponding to a width of an individual belt to 100 mm transversely of the water-impervious support member and projecting above a plane defined by a web supporting surface of said water-impervious support member by a height less than 1 mm.

4. A method for production of non-woven fabrics according to claim 1 wherein the web supporting surface of the water-impervious support member is flat.

5. A method for production of non-woven fabrics according to claim 1 wherein the web supporting surface of the water-impervious support member is circularly convex.

* * * * *